US005711760A

United States Patent [19]

Ibrahim et al.

[11] Patent Number: 5,711,760

[45] Date of Patent: Jan. 27, 1998

[54] SELF-INFLATING VENOUS BOOT

[75] Inventors: Ibrahim M. Ibrahim; Sharon Caruth Ibrahim, both of Closter, N.J.

[73] Assignee: Englewood Research Associates, Englewood, N.J.

[21] Appl. No.: 427,682

[22] Filed: Apr. 24, 1995

Related U.S. Application Data

[63] Continuation of Ser. No. 31,558, Mar. 15, 1993, abandoned.

[51] Int. Cl.[6] ..... A61H 9/00

[52] U.S. Cl. ..... 601/149; 601/150; 601/152

[58] Field of Search ..... 601/148–152, 601/22

[56] References Cited

U.S. PATENT DOCUMENTS

| | | | |
|---|---|---|---|
| 2,832,336 | 4/1958 | Davis et al. | 128/64 |
| 3,403,673 | 10/1968 | McCleod | 128/64 |
| 3,888,242 | 6/1975 | Harris et al. | 128/64 |
| 4,372,297 | 2/1983 | Perlin | 128/64 |
| 4,502,470 | 3/1985 | Kisa et al. | 128/64 |
| 4,624,248 | 11/1986 | Poole et al. | 128/64 X |
| 4,805,601 | 2/1989 | Eischen, Sr. | 128/64 |
| 4,848,324 | 7/1989 | Gauriely | 128/24 R |
| 4,883,462 | 11/1989 | Williamson et al. | 128/64 X |
| 4,941,458 | 7/1990 | Taheri | 128/64 |
| 5,022,387 | 6/1991 | Hasty | 128/24 R X |
| 5,080,089 | 1/1992 | Mason et al. | 128/24 R |

FOREIGN PATENT DOCUMENTS

| | | | |
|---|---|---|---|
| 39629 | 11/1981 | European Pat. Off. | 128/64 |
| 2737734 | 12/1978 | Germany | 128/24 R |
| 443601 | 12/1948 | Italy | 128/24 R |
| 260822 | 10/1970 | U.S.S.R. | 128/64 |
| 852328 | 8/1981 | U.S.S.R. | 601/152 |
| 483111 | 12/1938 | United Kingdom | 128/60 |
| 817521 | 7/1959 | United Kingdom | 601/151 |

*Primary Examiner*—Danton D. DeMille

*Attorney, Agent, or Firm*—Ostrolenk, Faber, Gerb & Soffen, LLP

[57] ABSTRACT

A portable apparatus for applying cyclic pressure to veins within a person's leg by applying cyclic pressure to an outer surface of the leg, the apparatus comprising a first air chamber having a flexible wall portion adapted to be situated adjacent an outer surface of the leg, a second air chamber adapted to be positioned beneath the person's heel, this second chamber being compressible to force air out of it when the person's heel bears downward thereon and returnable to its uncompressed state when the downward heel force is removed therefrom, and conduit means for permitting air flow between the first and second air chambers, whereby air flows from the second chamber into the first chamber and pressure is cyclically increased in the first chamber urging the wall portion against the leg when the person's heel presses downward on the second chamber, and air flows from the first to second chamber and pressure on the leg is reduced when the person's heel stops pressing on the second chamber.

37 Claims, 15 Drawing Sheets

SELF-INFLATING VENOUS BOOT

This application is a continuation of application Ser. No. 08/031,558, filed Mar. 15, 1993, now abandoned.

FIELD OF THE INVENTION

The present invention relates to a compression apparatus for applying cyclic external pressure to the outer surface of a person's leg or other limb. In particular, the present invention relates to compression apparatus worn against the outer surface of the lower leg for reducing and controlling the discomfort and disease caused by various venous disorders occurring in the lower leg.

BACKGROUND OF THE INVENTION AND DISCUSSION OF PRIOR ART

Venous disease is a common disorder that effects millions of people. The disease in many respects is more complex than arterial disease which is largely the result of obstructions in the vessels; however, the criticality of arterial disease and availability of various treatments has helped to focus the medical community's attention towards arterial disease instead of venous disease.

Venous disease effects many more people than those specifically identified and treated. Many of the unidentified ones suffer in silence as they voluntarily slow down, restrict their activities or learn to adjust by reducing the effects of gravity by elevating their legs or lying down. Disability from venous disease includes the regional problem usually occurring near the upper part of the ankle, but also there is a risk of escape of thrombi into the pulmonary circulation. The lost work time for patients is a substantial unregistered cost to society of the disease. Untreated patients are plagued with chronic edema, pigmentation, ulceration, pain, venous congestion and recurrent episodes of venous thrombosis, a painful and disabling condition which is largely incurable, but controllable.

The obvious function of the venous system is to return blood to the heart from the capillary beds. The veins also play a role in regulating vascular capacity and are part of a peripheral pump mechanism which assists the heart in the transport of blood during exercise. Of the two types of veins, superficial and deep, the large superficial veins are relatively thick walled and easily visible structures which lie just beneath the skin. The deep veins are thin walled vessels lying deep within the musculature and are often accompanied by arteries. These deep veins are responsible for the majority of blood flow back to the heart and are often three times larger than the cross sectional area of the adjacent artery. Veins are passive conduits that contain one-way valves for unidirectional flow towards the heart. Venous disease is caused by either blockage of the deep veins in the leg or by incompetent valves in the veins of the legs. The resultant effect is an increase in pressure in the collateral venous circulation of the leg.

The method of blood flow from the leg to the heart in an erect or active person is the muscle pump. In the calf the muscles contract, squeezing and emptying the veins. The blood flows in the vein towards the heart as a result of the one-way valve. Repetitive contraction of the muscles results in the continuous movement of venous blood antegrade towards the heart. If the valves are incompetent, blood can flow in either direction. If the vein is obstructed, blood flows only retrograde to make the valves appear incompetent. In either case for venous disease the normal muscle pump not only does not return blood to the heart, but actually increases the pressure in the leg.

Inadequate blood flow to the heart will result in swelling in the foot and lower leg which results in increased pressure in the leg. In a recumbent or supine position the pressure in the veins of the foot is about 12 mm Hg; when sitting it is about 56 mm Hg; when standing the pressure approaches 90 mm Hg. If a person with venous disease of the leg is standing versus recumbent there is an added approximately 80 mm Hg pressure on the capillary system, resulting in significant dilatation of the veins and extravasation of fluid to the tissue. If this process continues, it can produce edema and subsequently other pathological changes such as skin ulcerations.

When a vein is obstructed, as shown in FIG. 1 of the drawings herein, blood that would normally flow upward in the vein may exert enough back pressure to damage the adjacent valve. Thereafter, the damaged valve allows blood to be forced backward toward the foot. After such damage has occurred, the muscle pump not only does not effectively return blood to the heart but actually increases the pressure in the foot, as shown in FIG. 2, whether or not there is an obstruction. Valves may be incompetent for a number of reasons other than thrombosis. The incompetent valve will allow blood to flow away from the heart thus causing increase venous pressure in the foot. Some authorities believe that this additional, repeated increase in venous pressure at the ankle level that is caused by the contraction of the leg muscles is the principal cause of the swelling and resultant ulcerations that occur in these patients, in addition to the static pressure in the veins.

As schematically shown in FIGS. 3A and 3B, veins in the leg such as the femoral vein 10 contain cusp-shaped valve flaps 12 that allow blood flow upward per arrow 13, and under normal conditions meet to prevent blood from flowing in the downward direction indicated by the arrow 14 toward the patient's foot. When an obstruction 16 develops in the vein impeding blood flow per arrow 15, damage to these flaps may result when blood pressure in the vein below the obstruction is locally increased. Such pressure rise occurs when there is contraction of the adjacent leg muscle causing the inward-directed pressure indicated by arrows 17 in FIG. 3A and the resulting constriction 18. Valve flaps 12 below the constriction 18 are subjected to excessive back pressure that may stretch or tear the inner edge 19 of a valve cusp. This damage renders the valve incompetent for the task of preventing the downward flow of blood in the veins of the leg.

It is estimated that there are 4,880,000 new cases of venous disease treated each year. This includes 2,800,000 deep vein thrombosis, 1,400,000 post-phlebitic syndrome, 600,000 pulmonary embolisms, and 80,000 procedures for venous insufficiency/varicose veins. It is estimated that the prevalence of varicose veins is closer to 24,000,000 cases.

These numbers reflect the patients treated and do not include the expectant management patients which could make themselves available for a viable treatment. This disease is largely incurable and the new invention presented herein is largely palliative in nature. Therefore, the number of available patients increases with time. The new apparatus of the present invention will be especially useful as the society at large ages. It is estimated that the new device will be used on both legs for each patient even if the patient presents a problem in only one leg. It is expected there will be a higher patient compliance with this device since patients can actually feel the product working.

The treatment for this disorder involves three modalities, all of which rely on the same basic principle, namely the application of external pressure on the lower extremity to counteract the increased pressure on the collateral circulation. Apparatus for these three treatments are described as follows.

The first modality is the application of so called compression or surgical stockings. Elastic stockings are commonly worn by persons having venous disease such as venous ulcers, incompetent venous valves, deep venous thrombosis and varicose veins to prevent the swelling of the feet and lower legs. One type of this compression stocking is an Ace* bandage. Also, there are stockings sold under the names Camp*, Jobst*, and Sagvaris* that incorporate enough elastic bands in them to exert selected variable amounts of pressure on the lower extremity. The stockings are tailored to each individual leg by actually measuring the circumference of the leg at different levels and then manufacturing the stocking to have the particular degree of compression required by the severity and nature of the patient's disorder at a given time.

* Trademark of Manufacturer

Surgical stockings are difficult to put on because of the considerable strength required to stretch the stocking until it is properly positioned. Furthermore, dressings that may be applied to an ulcer in the leg may become displaced while the stocking is being put on. Also, many of these patients are elderly with one or more arthritic problems, and applying the stockings is so difficult that assistance of another person is required. Finally, when the swelling begins to subside, obviously the stocking becomes very loose and loses its effectiveness, so that a new stocking has to be purchased as the disease process ameliorates.

Compression devices such as surgical stockings that diminish the extravasation of fluid, thereby retarding the formation of edema, have been the mainstay of therapy for the above described problem. However, the constant compression provided by these stockings does not correct the repetitive, harmful increase in back pressure that is produced by contraction of the patient's leg muscles during walking. Nor do such devices recreate the dynamic, repetitive increase in the blood flow that occurs in healthy veins as the patient's leg muscles contract during walking.

The second modality is the so-called Unna* boot or Dome* paste. This is a medicated bandage that is applied circumferentially over the leg starting at the toes and extending all the way up to the knee. This is a semi-rigid dressing in that it is not as flexible as the surgical stockings, but also not as rigid as a plaster cast. This is the type usually used in cases of open ulcerations. After use this dressing cannot be removed for a few days, but once it is removed, a new one has to be applied. Also, it cannot be allowed to get wet. If it is too tightly applied, it may impede the circulation, thus jeopardizing the extremity. The Unna* boot is considered by some as more effective than the surgical or compression stocking since it has a semi-rigid quality.

The third modality is the intermittent pneumatic compression device, namely, a plastic boot that can be pressurized by a pump. This device is applied on the leg and then attached to a compressor which pumps air into the device to a pre-set pressure, lets it remain there for a few seconds, and then releases it. This is best used to relieve very significant edema in the extremities. Unfortunately, this system of boot and compressor is heavy and cannot be used continuously. Thus, its use is mainly confined to the hospital or the patient's home, and obviously, with this device the patient has little or no mobility.

Each of the three modalities of treatments above have numerous and serious drawbacks has been described.

SUMMARY OF THE INVENTION

A principal object of the present invention is to treat venous disease of the leg by providing dynamically variable compression to the outer surface of the lower leg.

A further object of this invention is to reduce or prevent additional damage to already damaged veins in the leg. More particularly, we seek to recreate a dynamic and repetitive increase of the pressure on the extremity from the foot upwards as the leg muscles contract. Thus, we seek to counteract the repetitive increase in the retrograde pressure on the lower extremity by muscular contraction.

A still further object of this invention is to provide a convenient, comfortable and totally mobile apparatus for applying dynamic pressure to wearer's lower leg, the apparatus preferably being a boot worn on the leg.

Another objective is to provide a mobile dynamic compression apparatus for the lower leg where the user can inflate a pressure chamber merely by walking with no requirement for a pump or other external source of compressed air.

The present invention achieves these and other objectives by an apparatus generally in the form of a boot which includes (a) a pressure application means such as an air cell or resilient air chamber situated adjacent the wearer's lower leg, (b) a pump means such as a compressible and resilient bulb or air chamber situated below the wearer's heel, (c) a fluid conduit means, such as a tube providing an air passage between the pump means and the pressure application means, and (d) appropriate valve means.

This invention is an apparatus and method for applying cyclic pressure to the outer surface of a person's lower leg while the person is walking and remains fully mobile. A bladder or other elastic air chamber is situated against the leg and cyclic air pressure is applied via the bladder to the surface of the leg. This cyclic air pressure is supplied by a pump preferably situated below the person's heel so that as he walks each step downward on the heel actuates the pump to drive air into the bladder. Further stepping off the heel releases the pump to draw air back.

This cyclic pressure applied to the blood vessels within the leg substitutes for or supplements the pumping action that would occur in a normal healthy leg by contractions of the calf muscle. Because the venous disease greatly diminishes this pumping effect, the expanded air cell or bladder will apply a substitute pressure to drive the blood upward and not let excessive pressure develop below the obstacle or damaged valve.

In this operation the bladder and pump comprise a closed air system. A valve device is provided to allow this system to operate selectively in any of three modes: inflation of the system, cyclic pressure mode during walking, and deflation of the system. Inflation may be from an external source of compressed air, or preferably is achieved by appropriate operation of valves as the user takes a number of steps, hence the title herein "Self-Inflating Venous Boot."

To achieve this inflation a charge of air is drawn into the system by expansion of the pump when the foot is lifted; as the person steps down air is then driven by the pump into the bladder. This procedure is repeated a number of times until the system is adequately inflated to approximately 50 mm of Hg. The system is then closed and isolated from further inlet air, such that air merely reciprocates between the pump and the bladder as the person walks. The pressure can be increased or decreased as required by inlet or release of air from the system, and when desired the system can be fully deflated by opening the system via appropriate valve means to the atmosphere. The preferred embodiment disclosed herein includes a single compact valve unit that allows all of the above-described modes of operation.

The bladder or pressure chamber is situated in the area slightly below the knee (4 to 5 cm below the patella), covering the calf to the ankle and metatarsal area. This bladder may fully surround the leg or pressure may be applied to selected areas of the leg. The pumping action is achieved merely by walking and using the person's own weight, with no additional muscle effort required and no additional or external power source or apparatus required. This inflatable bladder is sufficiently flexible to generally conform to the shape of the calf and leg and distribute the pressure substantially evenly and cause minimum discomfort. The apparatus is designed to avoid hard contact or excessive pressure with the protruding malleolus of the tibia and fibula.

In a preferred embodiment the pump is configured to fit within a relatively normal appearing shoe, and the primary pressure-applying chamber is a sleeve or boot-like member that surrounds or is situated against the lower leg. In such preferred embodiment additional compression means is provided by an elastic sock or partial sock surrounding the instep or portion of the foot forward of the ankle including or not including the toes. The pump in one convenient form is a resilient elastic chamber that is compressed by heel pressure and upon absence of heel pressure expands naturally and draws air back into it from the bladder.

The valve means for this air system comprises various valve functions which may be separate valves or as in the preferred embodiment are combined into a single device. In inflation mode air is allowed by an inlet check valve to enter the system but not escape; then air must flow from the pump into the bladder but not return to the pump. During the normal operation of walking mode air must freely reciprocate between the pump and the bladder. Finally, in release mode air must be free to exit the system and deflate the bladder. With the combination valve apparatus, the user manually adjusts the valve for the selected mode of operation. Alternatively, the valve means can operate automatically to close at a pre-set pressure during inflation mode.

In one embodiment the boot or bladder has an inner surface or layer of fleece or other natural or synthetic material that is soft and washable, allows movement of air or perspiration on the surface of the leg, and permits application of medication to the skin if necessary.

The bladder itself may be formed of a sheet or cuff that is wrapped around and secured to the leg, and subsequently inflated so as to apply pressure inward against the leg. Alternative pressure means may be used against specified parts of the leg. In a still further version one or more semi-rigid sheets, such as a set of front and rear sheets encase the leg with the bladder or other elastic air chamber between the leg and an inner surface of a shell. Inflation of the chamber within the confined space between the shell results in pressure application against the leg.

There will be an optional air pump such as an electric motor pump the patient can use at home or office when he is relatively inactive and not walking. Such pump would produce cyclic pressure applied to the bladder's air system whenever desired.

BRIEF DESCRIPTION OF THE DRAWINGS

FIG. 11A–11F are views of the pump, respectively of top plan, left side elevation, first sectional, rear end, second sectional, and third sectional views.

DETAILED DESCRIPTION OF THE PREFERRED EMBODIMENT

Figure 1:
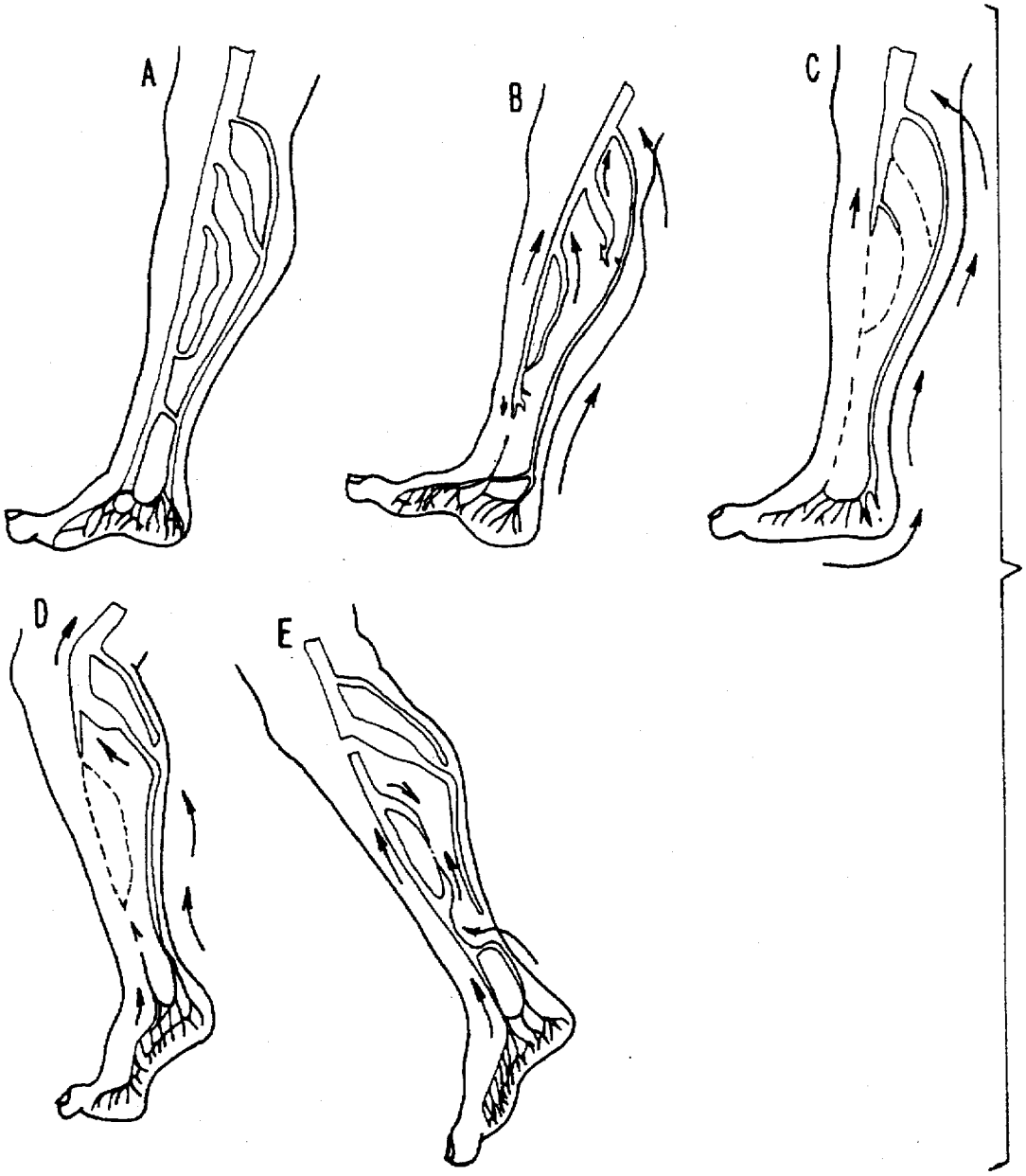
FIG. 1 PRIOR ART
FIG. 1 is prior art showing a sequence of venous volume changes in the calf with walking.
Figure 2:
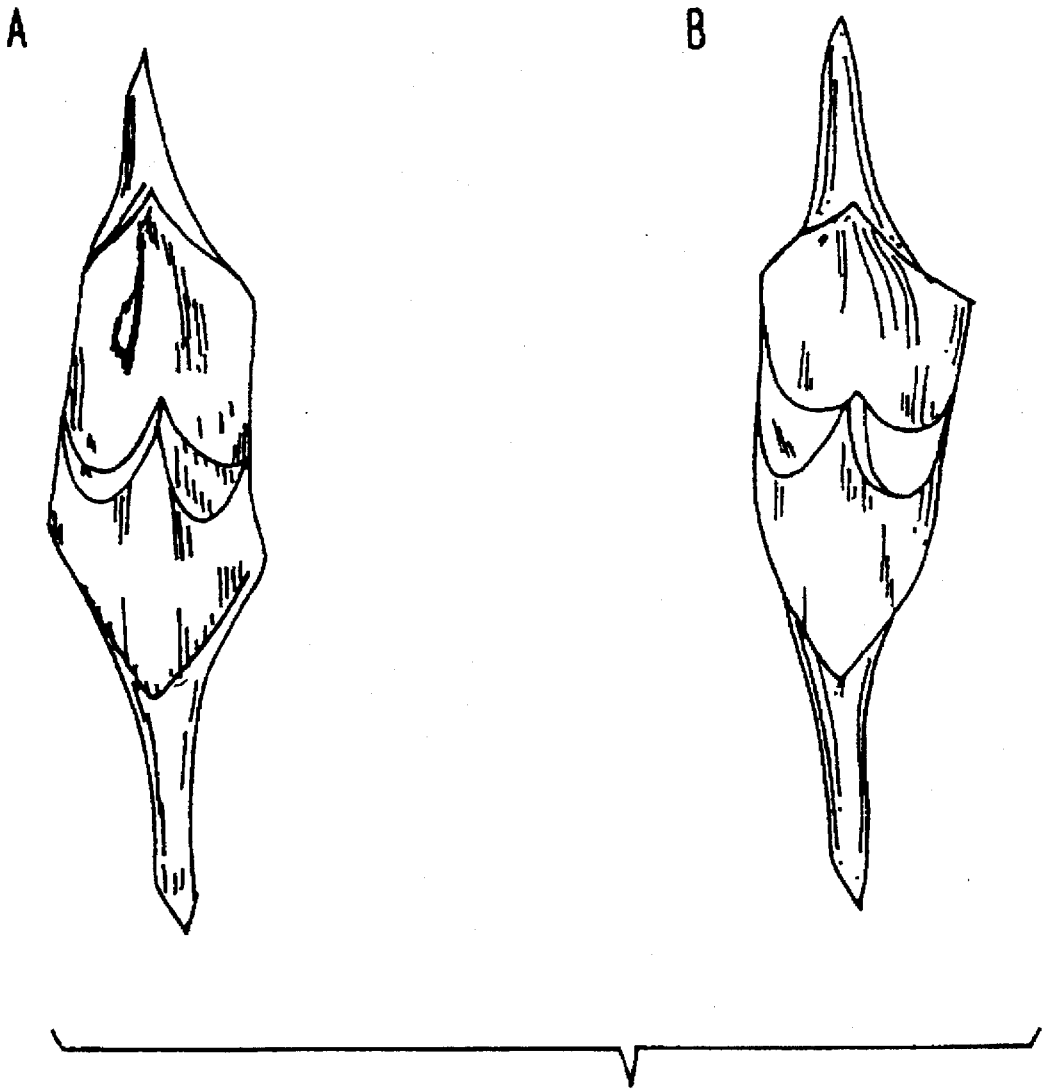
FIG. 2 PRIOR ART
FIG. 2 is a prior art showing sectional view of a femoral valve in its pre-repair damaged state and post-repair after the leading edge of casp was shortened.

FIGS. 1, 2 and 3 are schematic illustrations of prior art human anatomy which were discussed earlier on pages 3–5 of the specification herein. Specifically, FIG. 1, parts A–E, shows a sequence of venous volume changes in the calf with walking, wherein A represents resting, B represents the heel pressed against a support (early muscle contraction), C represents the entire foot pressed against a support (muscles fully contracted), D represents the knee flexed (forefoot compressed to floor, soleus contracted, gastrocnemius relaxed), and E represents the foot now unloaded (all muscles relaxed).

FIG. 2, parts A and B, illustrate femoral valve cusps pre- and post repair. Before repair (part A) the valve cusp was loose and floppy and severely incompetent. After repair (part B) the valve was completely competent. The valve repair involves placement of a series of interrupted sutures designed to shorten the leading edge of the valve cusp. Interrupted sutures are placed repeatedly until the leading edge of each cusp lies gently across the surface of the vein, and is neither taut nor lax.

Figure 3A:
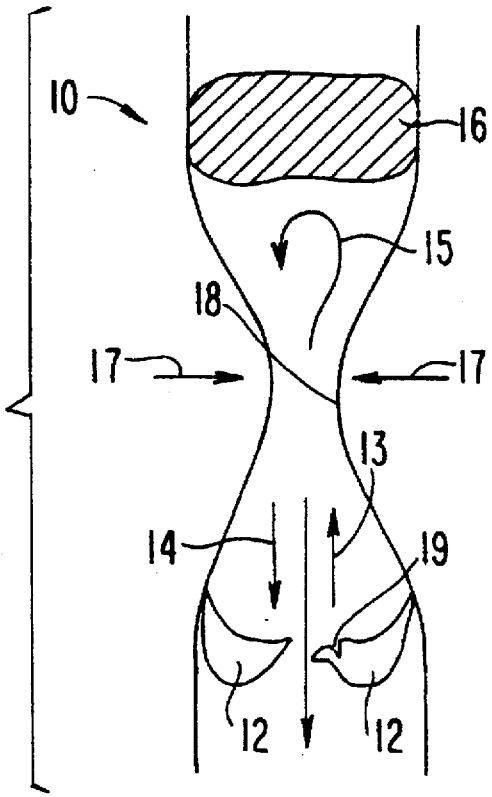
FIG. 3A PRIOR ART
FIG. 3A is a prior art showing schematic representation of the affect of an obstruction in a vein on valve action in the vein.
Figure 3B:
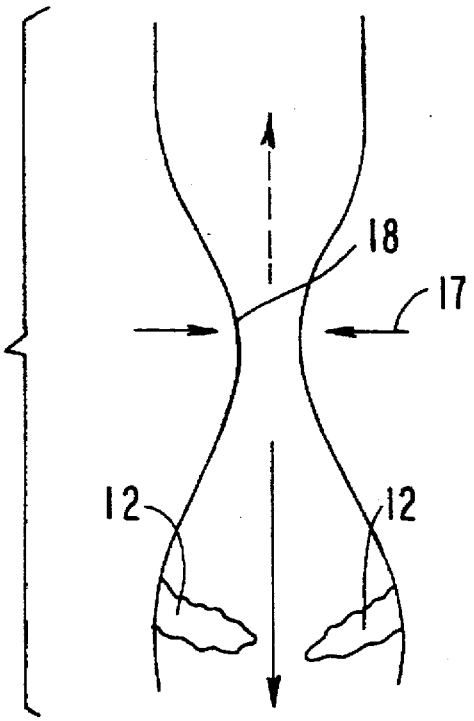
FIG. 3B PRIOR ART
FIG. 3B is a prior art showing schematic representation of the affect of an incompetent valve on antigrade venous circulation.

FIGS. 3A and 3B are described in detail on page 4 and 5 above.

Figure 4:
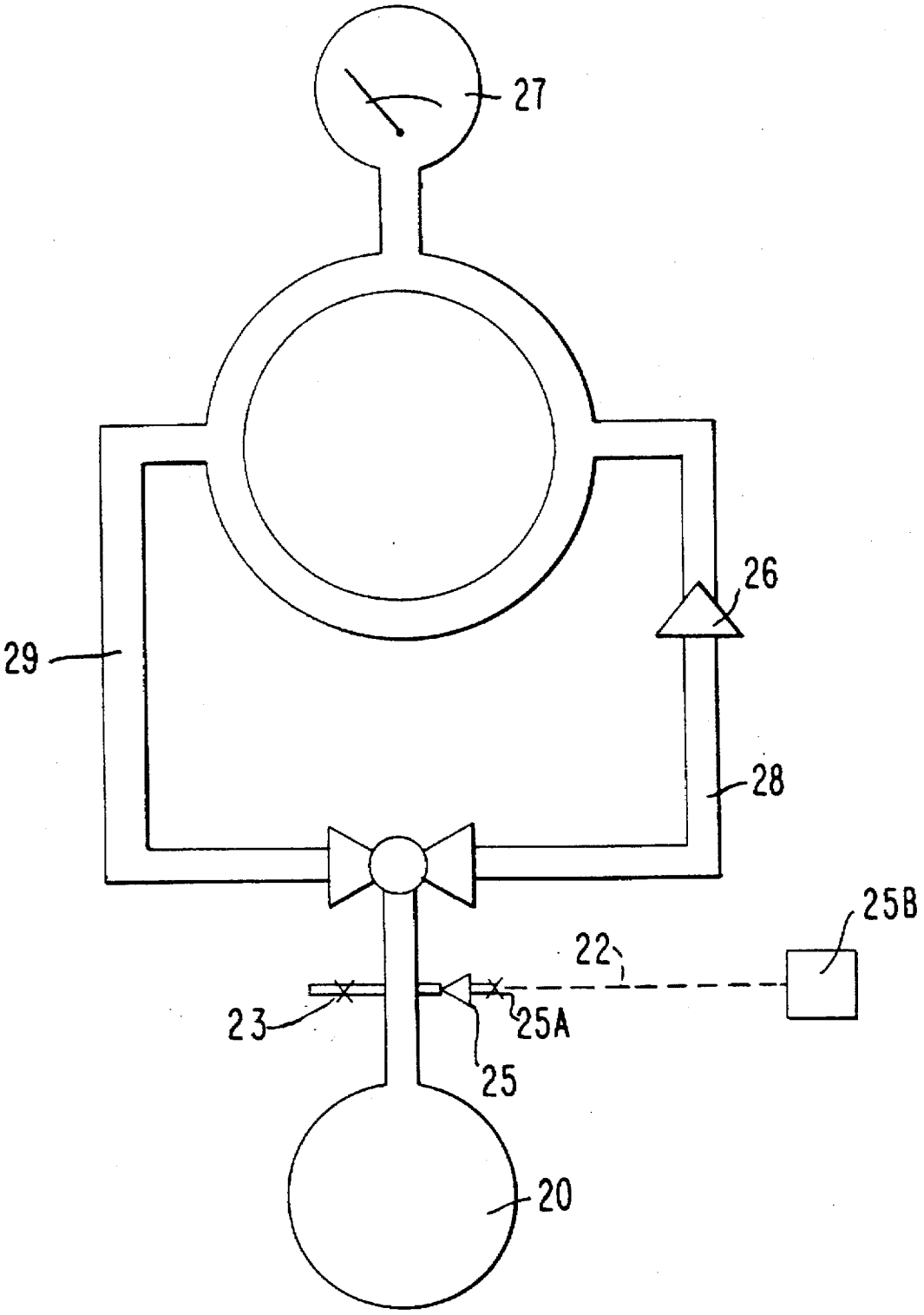
FIG. 4 is a schematic drawing showing the pressure system of this invention comprising a pump, valves, and an air cell pressure chamber.

The preferred embodiment of the new invention is shown in FIG. 6B as applied to a person's leg and in FIG. 4 in schematic form. The components as seen in FIG. 4 are a pump 20, a switchable valve 22, a bladder or flexible air chamber 24, an inlet check valve 25, a one-way valve 26 and a pressure gage 27. Between valve 22 and bladder 24 is an inflating line 28 and a separate exchange line 29.

In use the bladder 24 is applied to or wrapped around and secured to the patient's leg. Valve 22 is switched to open the line 28 to pump 20, and to close the line 29 to pump 20. A compression stroke of pump 20 as applied by the person's heel when walking drives air via open line 28 through one-way valve 26 into the bladder. This air cannot escape via line 29 which is closed by valve 22; the air cannot escape via line 28 because of one-way valve 26.

By beginning to take a step the person's heel lifts off the pump which then expands and draws in air from the atmosphere via inlet valve 25 while the outlet valve 23 is closed. On the next step downward the heel compresses the pump and drives this additional charge of air through line 28 into the bladder further inflating it. This charge of air from the pump cannot flow elsewhere than to the bladder, because valve 22 is closed to line 29 and valve 27 is one-way "in" only.

After a number of steps, 5 to 10, the bladder is adequately inflated, which can be verified by pressure gage 27. Then inlet valve 25 is closed by control 25A, and valve 22 is switched to open line 29 between pump and bladder 24 and to close line 28 from the pump to the bladder. Now there may be free reciprocal flow in line 29 between the pump and the bladder with each step onto and off of the pump. As discussed on page 10, lines 18–19 herein, initial inflation could be from an external source of compressed air instead of by suction from the pump operation. The optional alternate air source is indicated as 25B and a dotted line communicating with valve 25 and control 25A.

Finally, when the patient seeks to terminate this session he merely opens release valve 23 and air over atmospheric pressure will flow out of the system via line 29.

Figure 5:
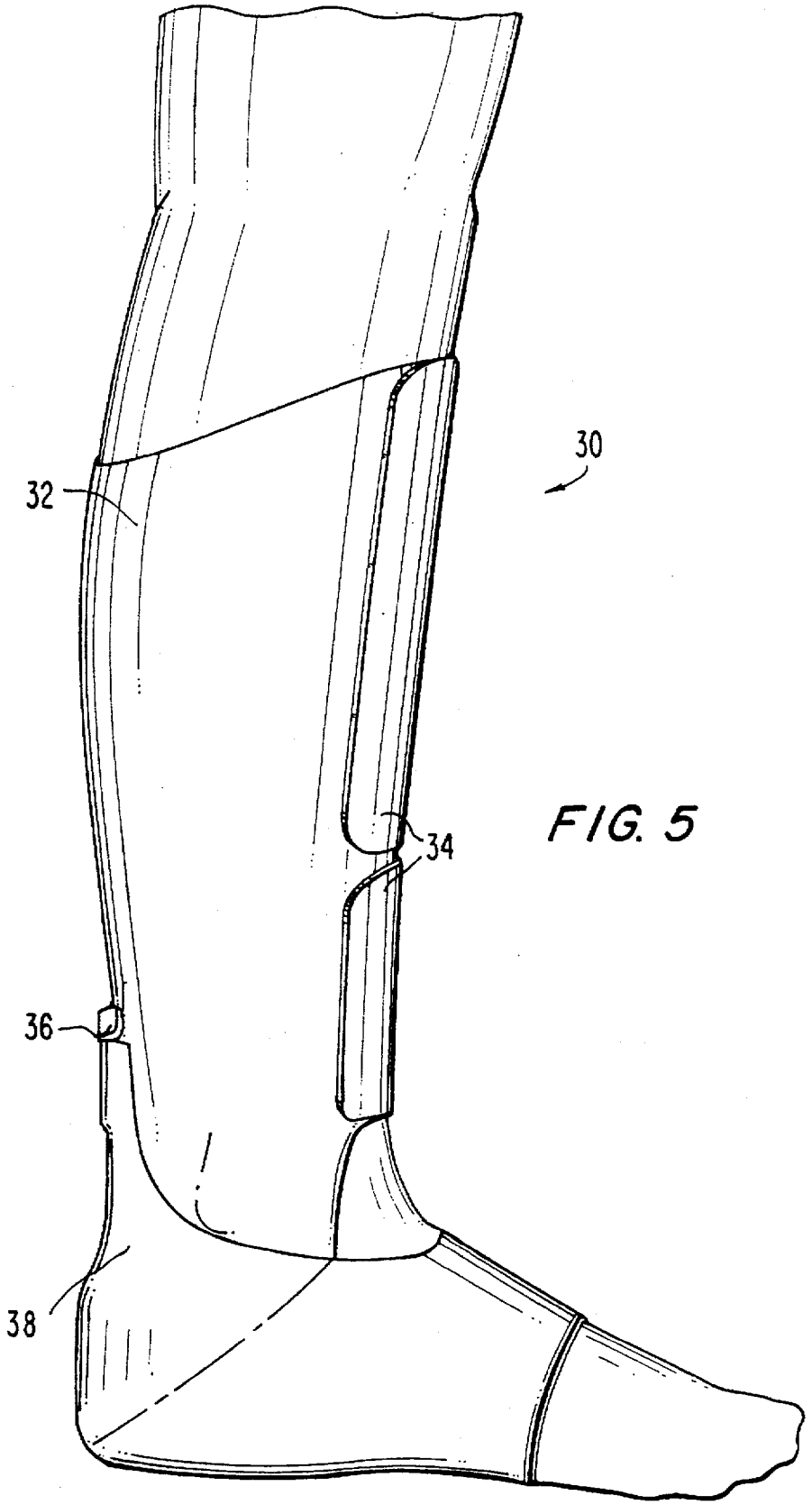
FIG. 5 is a side elevation view of the new self inflating venous boot.

The new venous boot, also called AirSoc* or Self-Inflating Boot of the present invention is shown generally schematically in FIGS. 5–8. In FIG. 5 the venous boot 30 comprises the wrap around outer shell 32, the Velcro® tabs 34 for adjustably securing the boot around the foot and calf, the valve assembly 36 which is located in a convenient place for the user to reach and operate with one hand, and a valve assembly/tube cover 38 which houses the valve conveniently in the vicinity of the person's ankle.

Figure 10:
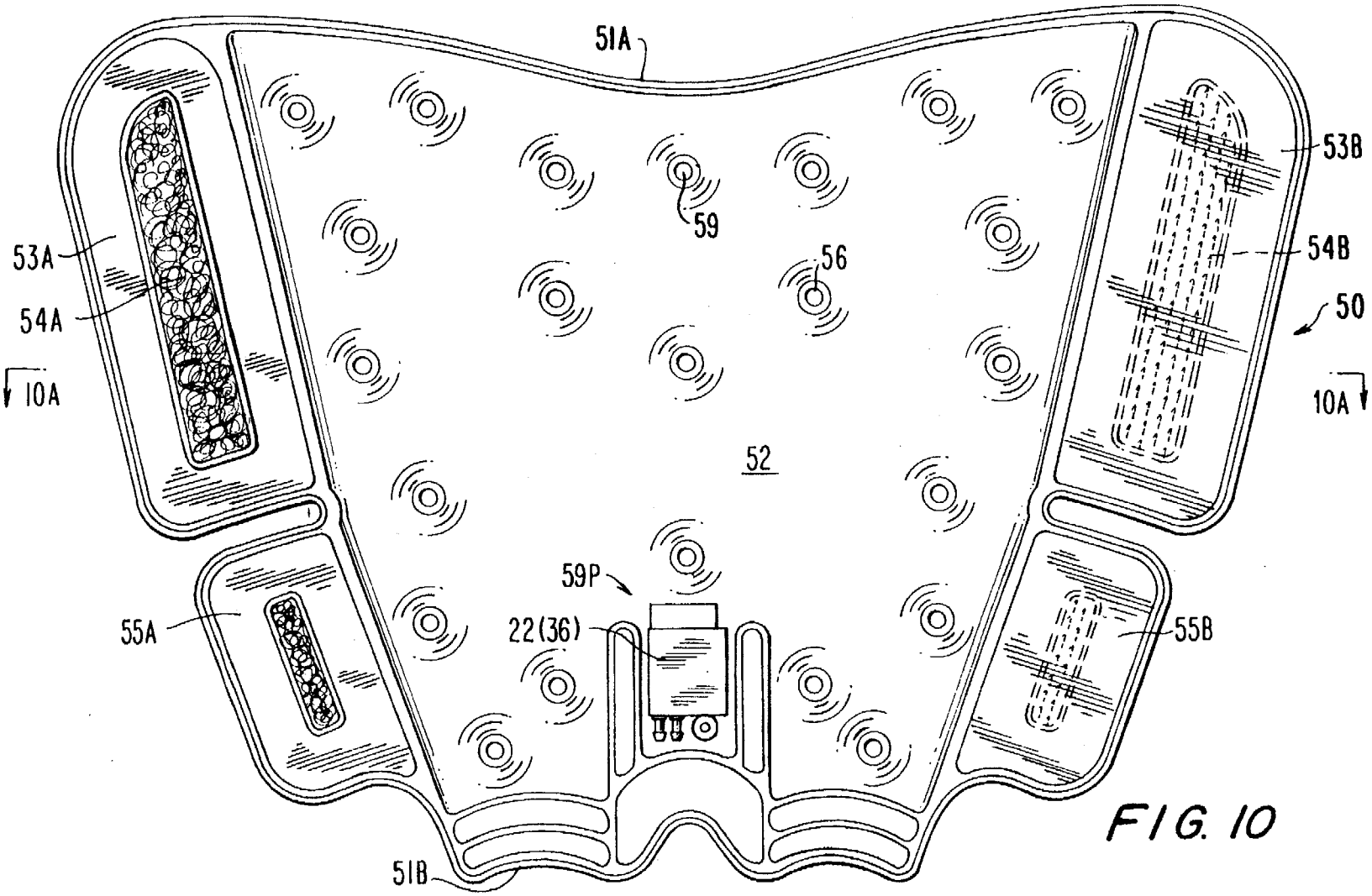
FIG. 10 is a plan view of the fabric pattern form for constructing the air cell or air pressure chamber.

FIG. 10 shows the outer shell 32 in its flat form as a two-layer sheet 50 having a generally trapezoidal shape with top edge 51A and bottom edge 51B. The peripheral edges of the two layers are sealed to form an inflatable bladder which is described in greater detail later.

Figure 6:
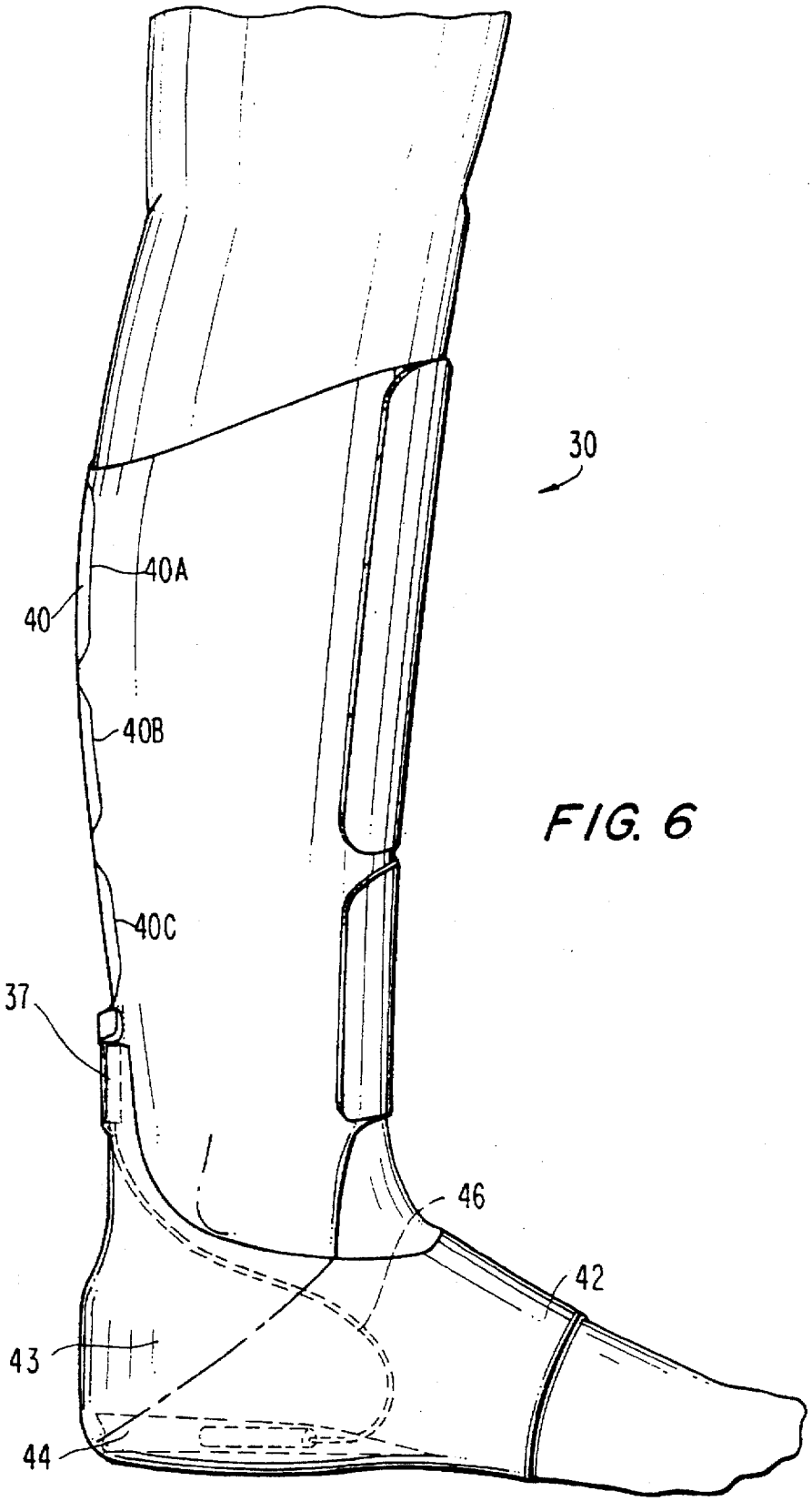
FIG. 6 is similar to 6A and is cut away to show components of the new venous boot.

FIG. 6 is a partially cut away view of the venous boot of FIG. 5 and illustrates the bladder or air chamber 40 divided into separate pockets 40A, 40B, 40C etc. A lower sock 42 is situated at the bottom of the boot for surrounding or encasing the middle of the user's foot. Adjacent the lower sock is the upper sock portion 43, and at the top of the upper sock is the valve assembly housing 37. Situated below the user's foot and situated within a pocket at the bottom of the lower sock or below and adjacent lower sock bottom is an innersole pump 44. From the innersole pump is a connector tube 46 which extends to the valve assembly 36 in housing 37. An outlet tube directs air from the valve 36 into the bladder 40.

Figure 7:
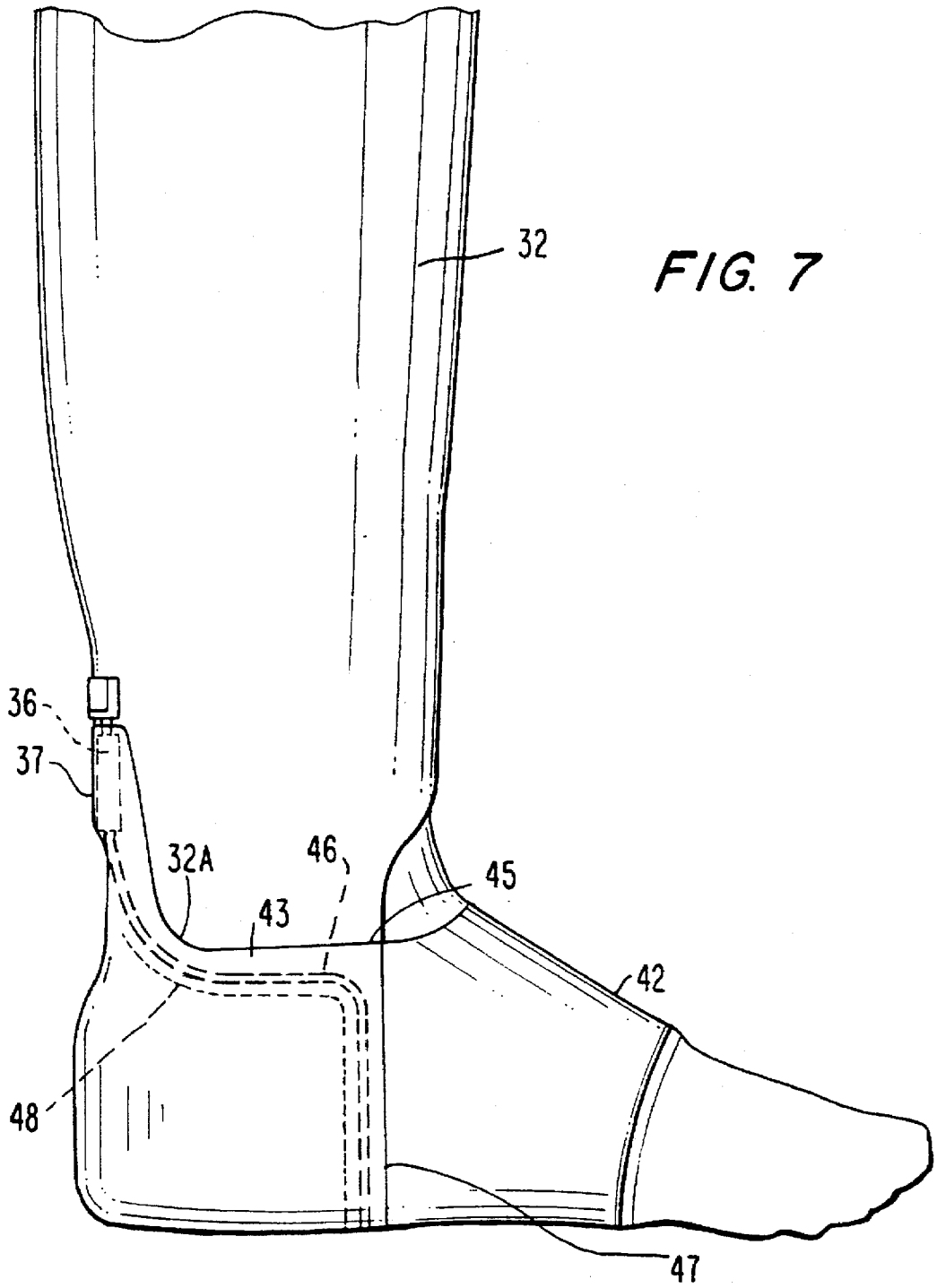
FIG. 7 is a side elevation view similar to FIG. 6B showing further detail of the construction of the boot in another embodiment.
Figure 8:
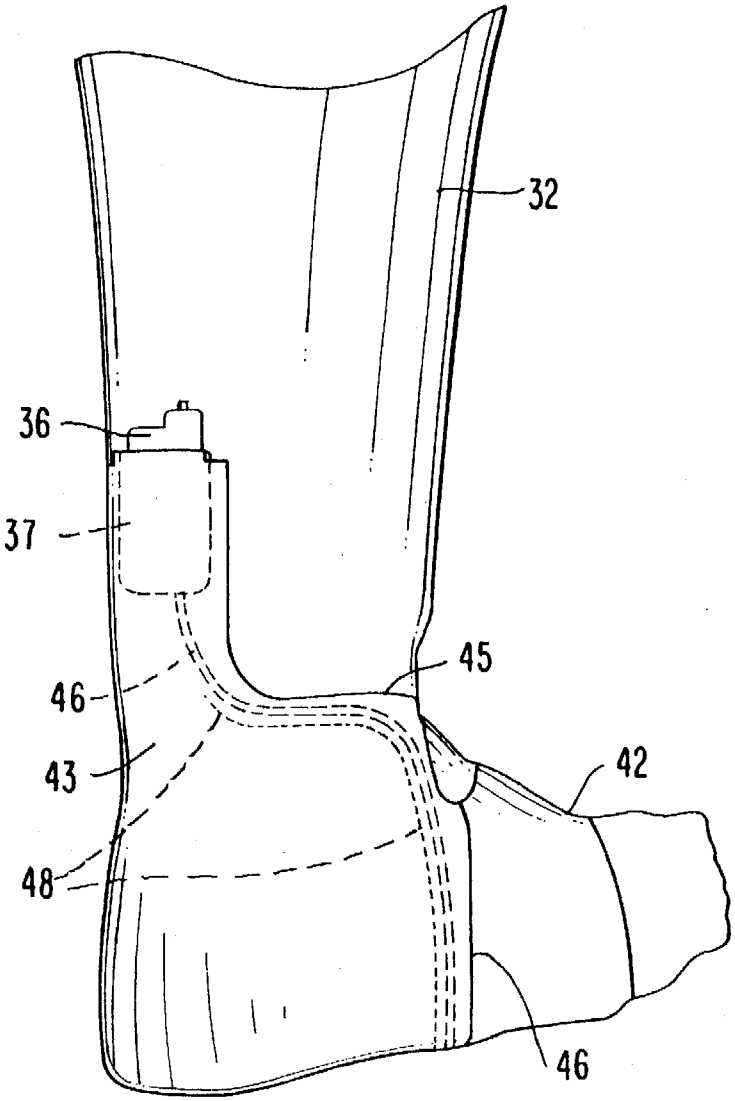
FIG. 8 is a rear perspective view of the boot of FIG. 7 showing additional construction thereof.

FIGS. 7 and 8 illustrate further details of the construction of the lower and upper sock or slight variation thereof for this boot. The same reference numbers are used for similar components as in FIG. 6. The boot's outer shell 32 has a lower part 32A which is joined to the upper sock 43 along a seam 45. An additional seam 47 is shown joining the lower sock 42 to the upper sock 43 as shown in FIGS. 7 and 8. There is stitching 48 forming a path for the tubing 46 on the inside of the sock. This tubing 46 leads to the valve 22 situated in valve assembly housing 37. Obviously it is important that tubing 46 be situated and protected such that it will not get pinched and block any air flow from pump 44 (FIG. 6) to the valve 36. Also the valve is situated in this embodiment at the rear of and slightly above the ankle so that it is easily accessible but not likely to interfere with walking or be struck by the opposite foot or by anything against which the leg is likely to brush.

The lower sock 42 is elastic that is stretched circumferentially when put on the foot and applies inward compression to the foot. Upper sock 43 is made of the same elastic to snugly encompass the heel and the remainder of the foot rearward of the lower sock. The elastic may be generally similar to the elastic strip used in an ACE* bandage.

Figure 9:
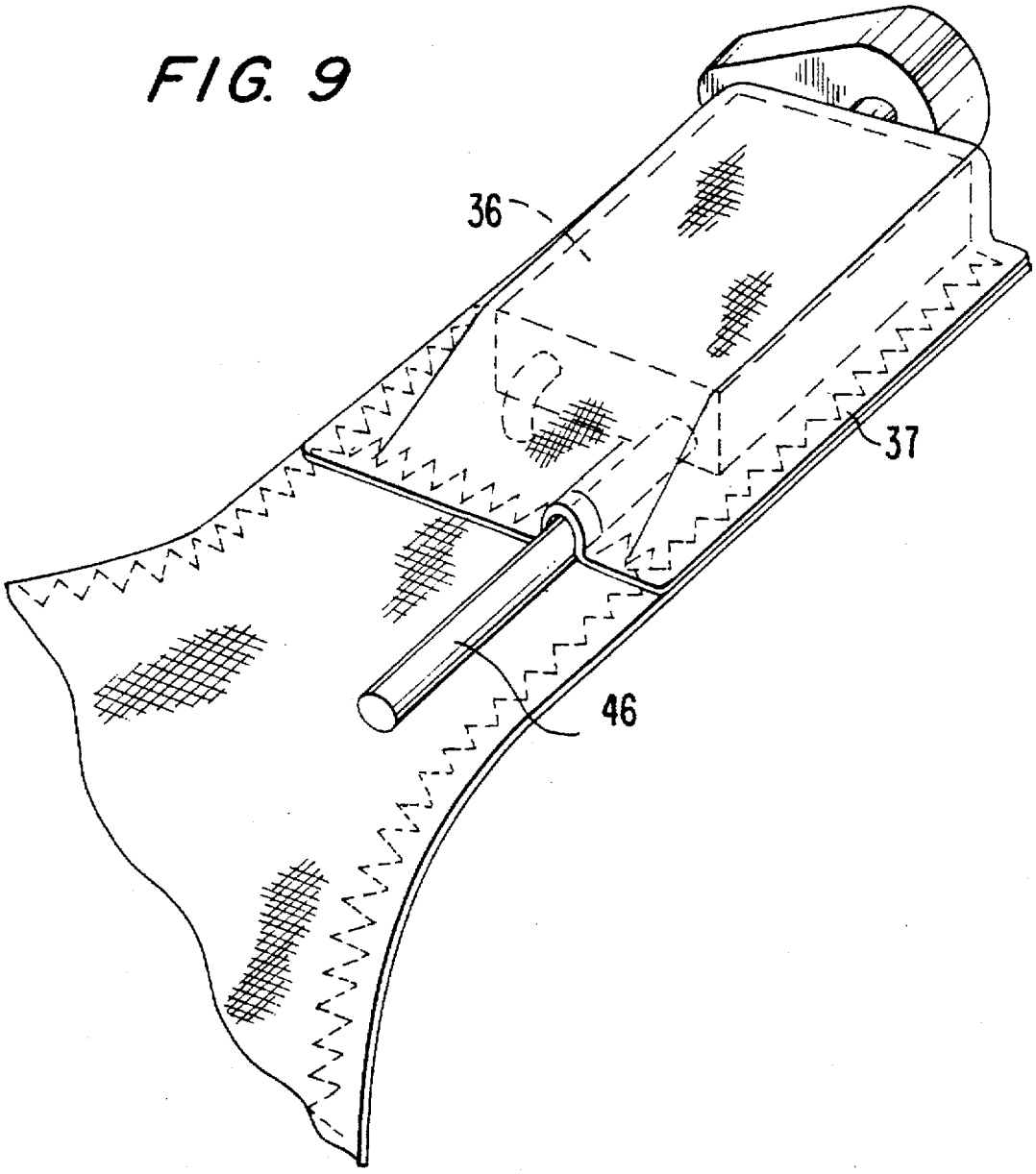
FIG. 9 is a fragmentary view of the boot showing the valve inserted in a holding cover.

FIG. 9 shows greater detail of the valve assembly housing or pocket 37 wherein valve 36 is situated. The valve assembly 36 is positioned to engage and seal with the upper end of tube 46. At the top of the valve is a lever or knob for the user to easily actuate the valve between its various modes of operation.

FIG. 10 shows a cutout pattern or form for the bladder or air pressure chamber. This form is somewhat butterfly-shaped in appearance, with a central part 52 with opposite left and right or side wings 53A and 53B. These wings have mating tab parts with Velcro® tape 54A and 54B respectively so that the central part 52 can be wrapped around a person's leg, and then tab 54B can be flapped over to engage the mating Velcro® tab 54A. The Velcro® tape is situated such that it can engage in a variety of different positions, and thus the tightness of the boot wrapped around the leg can be easily adjusted. There are smaller wings 55A and 55B which engage similarly as the other wings at the lower part of the leg below the calf.

Figure 10A:
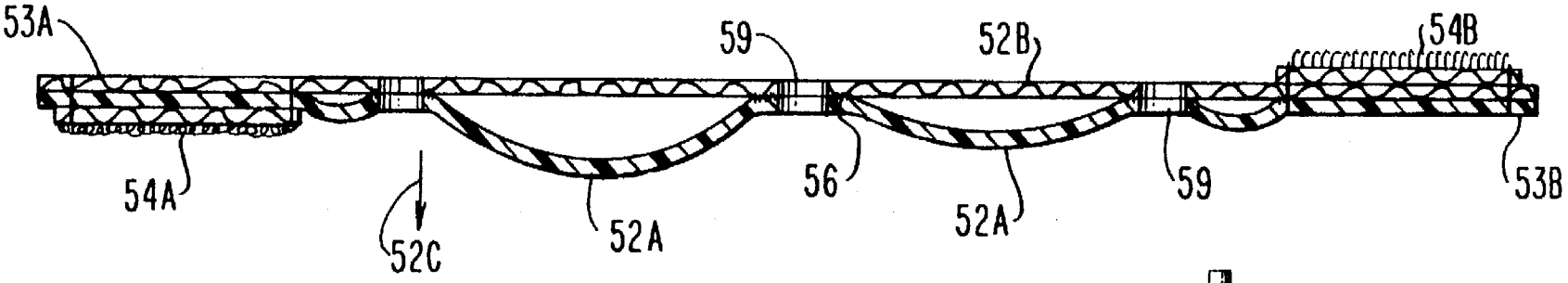
FIG. 10A is a sectional view taken along lines A and A of FIG. 10.

This sheath or web is wrapped around the leg as readily seen in FIGS. 5 and 6 where the Velcro® tabs are visible in front. FIG. 10A shows a cross-sectional view of the boot webbing of FIG. 10. As is apparent this web is formed of two layers 52A on the inside and 52B on the outside. These layers are joined together by heat sealed welds at numerous places represented by the example 56. As can be seen in FIGS. 10 and 10A the air chamber extends through the majority of the web except that internal air flow must pass around any of these welded areas 56 which join and secure layers 52A and 52B together. This is to prevent 52A and 52B from billowing out into the shape of a balloon. Accordingly this bladder can be inflated so that inside surface 52A presses in the direction of 52C (See FIG. 10A) while retaining its general shape in the form of a mattress. These various welded areas 56 optionally and as shown have apertures 59 punched therethrough to allow air to flow in through the boot and onto the patient's skin or sock or other covering that he might be wearing. FIG. 10 further shows the pocket area 59P for receiving and holding the valve 36 if appropriate cutouts are made for tube 46 from the pump to reach and connect with the valve and for another tube to extend from the valve to an inlet nipple (not shown) into the bladder.

The air chamber of the bladder of the preferred embodiment is two layers of 5½ mil polyurethane. In the structure shown herein the outer layer is 420 Dernier Nylon with a 5½ mil coating of polyurethane as its inner surface. The peripheral edges of the two polyurethane layers and various spaced intermediate areas 56 of these layers are heat sealed together. The nylon fabric is generally non-stretchable to provide appropriate strength to the bladder. This fabric is available from Mann Industries Inc. of Birmingham, Mass. 01701.

Figures 11A, 11B, 11C, 11F:
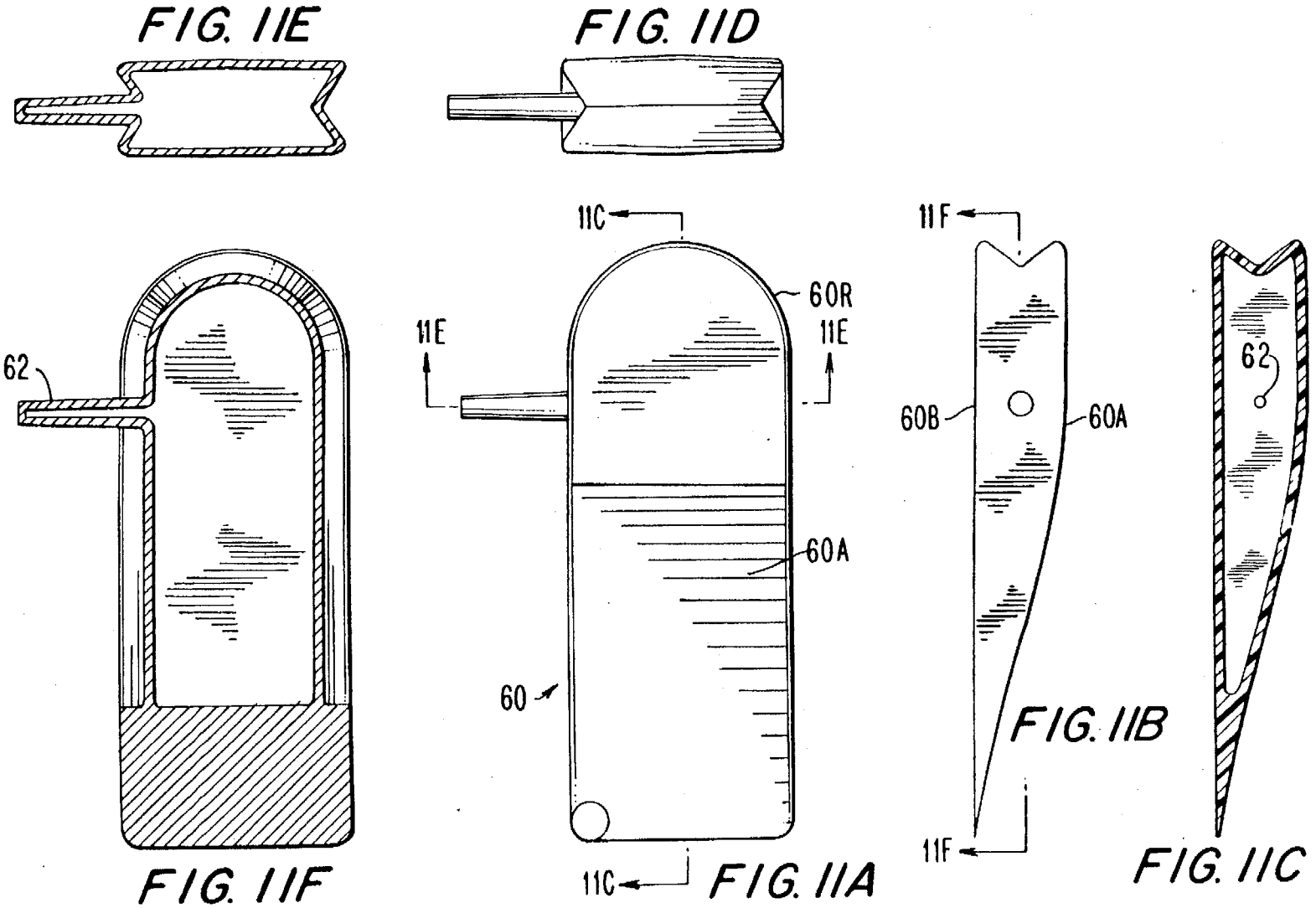

FIGS. 11A–11E show the construction of the foot pump (innersole pump) 44 as indicated schematically in FIG. 6. This is a one-piece molded resilient rubber or plastic device. FIG. 11A shows embodiment 60 as somewhat rectangular with the rear end 60R rounded to generally conform to the inner heel area of a person's shoe. FIG. 11B shows that the pump 60 is tapered generally conforming to the arch of a person's foot so that top portion 60A is positioned directly under the person's heel and arch, and lower portion 60B resides adjacent the bottom of the person's shoe.

FIG. 11C is a cross-sectional view of FIG. 11B with 62 being an aperture of inlet/outlet nipple 62 which is later connected to tube 46 as seen in FIG. 6. FIG. 11D is a rear end elevation view, and FIG. 11E is a sectional view similar to 11D. Finally, FIG. 11F is a sectional view showing the inner structure of the device of FIGS. 11A and 11E. FIG. 11F shows more clearly the outlet nipple 62 which is directed to and coupled to tubing 46. As stated earlier, this pump is a one-piece molded resilient plastic or rubber apparatus. Obviously, there are many variation constructions, including a flexible but not resilient pump chamber with an internal spring urging the pump to its expanded state.

As shown the pump has an air volume of about 4–5 cubic inches, a 65% pumping efficiency, and is constructed of an 80 Durometer elastomeric material that can sustain multiple impacts at pressures of up to approximately 385 psi without rupture.

Figure 12:
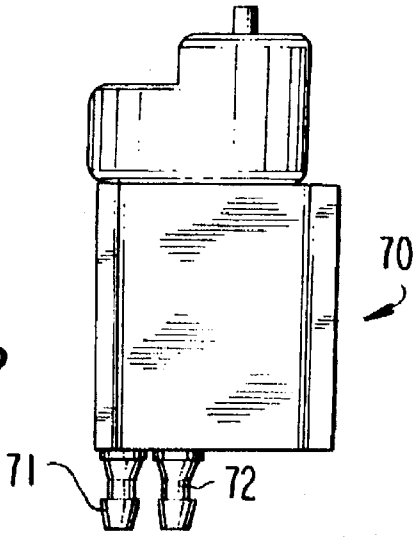
FIG. 12 is a front elevation view of a preferred embodiment of the valve assembly.
Figure 13:
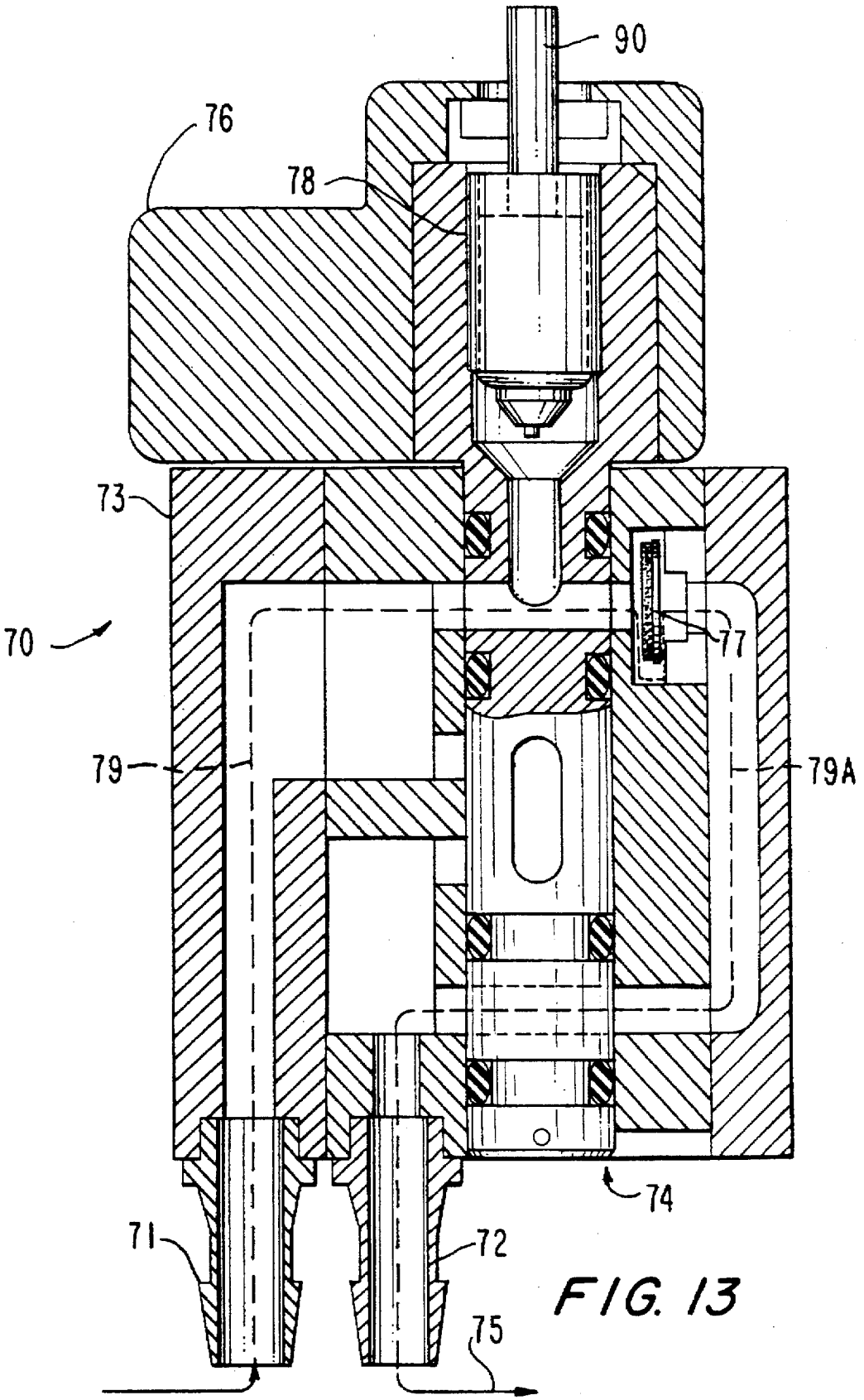
FIG. 13 is an enlarged sectional view of the valve assembly of FIG. 12 with the valve assembly switched for "Inflation" and operating in "Bladder Fill" mode.
Figure 14:
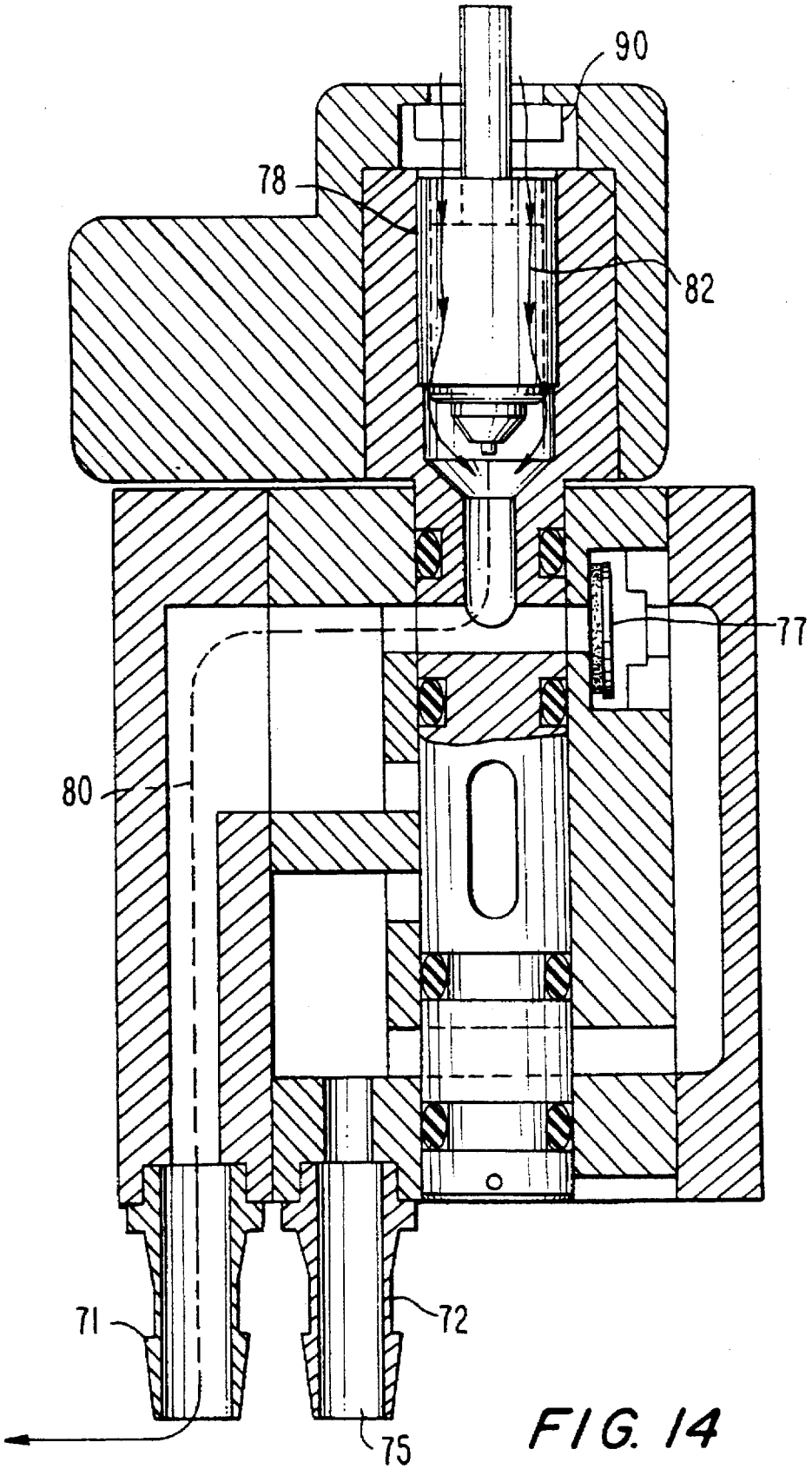
FIG. 14 is a view similar to FIG. 13 with the valve assembly switched for "Inflation" and operating in "Foot Pump Fill" mode.
Figure 15:
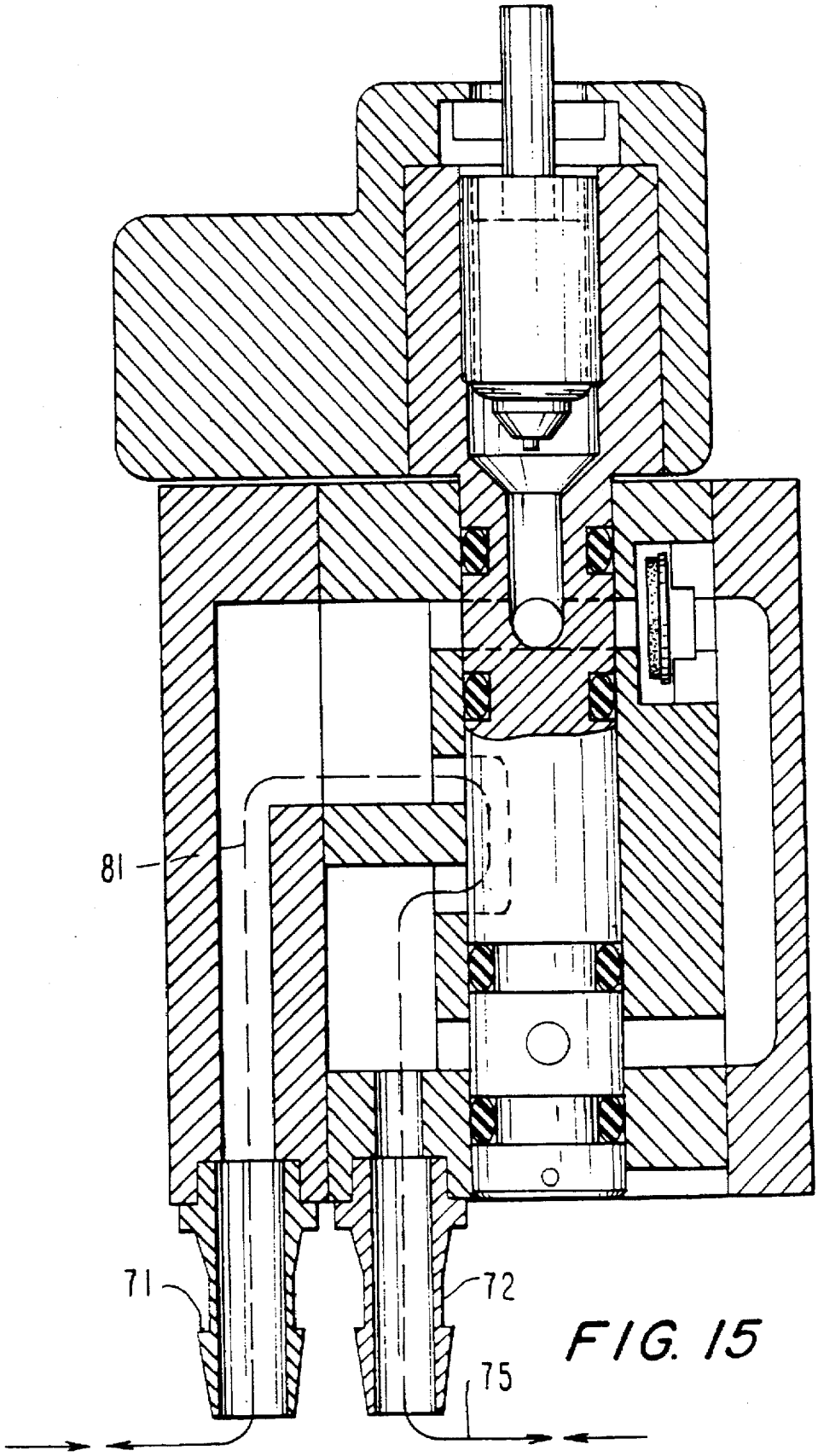
FIG. 15 is a view similar to FIG. 13 with the valve assembly switched for "Walking" and operating in "Reciprocating" mode.

FIG. 12 shows a plan view of the valve assembly 70 as might be used for the valve assembly 36 seen in FIGS 5–9. FIGS. 13, 14 and 15 show sectional views of this valve in three different modes of operation. Valve 70 has two fittings or nozzles 71 and 72 for connection to the exchange line 29 and the inflation line 28 respectively of FIG. 4. The inner structure and operation are described as follows. The valve assembly 70 (designated 22, 23, 25 in FIGS. 4A and 36 in FIGS. 5–8) comprises a bottom or housing 73 which defines a cylindrical bore 74, a rotary piston 75, an actuator or rotary knob 76, a disc check valve 77, and a relief check valve 78. This valve assembly has three modes of operation; however, first we will describe certain structural and functional features.

When the piston is rotated air flow passages are established as shown by the dashed line 79 in FIG. 13 or by dashed line 8 in FIG. 14. These lines include passages transversely through the piston in FIG. 13. When the piston is rotated 90° as shown in FIG. 15 the above-mentioned through-passages are blocked and sealed, but instead there is a different internal passages shown by dashed line 81 whereby the piston blocks the prior passages. Disc check valve 77 allows flow from left to right in FIG. 13 but not from right to left in FIG. 14. Relief check valve 78 allows flow in from the atmosphere per arrows 81 in FIG. 14 when the pump creates a partial vacuum as applied to fitting 71. Under a positive pressure situation in FIG. 13 the relief check valve 78 remains closed.

In the Bladder Fill Mode of FIG. 13, the foot pump outlet tube is connected to fitting 71. Air flow under positive pressure occurs along dotted line 79 through one-way check valve 77 and into the bladder. Successive pressure strokes of the pump add incremental charges of air into the bladder until it is adequately filled. With each pressure stroke air can enter the bladder but not leave. All other passages within the valve assembly 70 are blocked.

After each pressure stroke of the pump there is a suction stroke, Foot Pump Fill Mode of FIG. 14, where the pump expands and draws in a new charge of air from the atmosphere. The new air comes from outside the system via relief check valve 78 and passage 80. During this mode the pump creates negative pressure in the system, which both draws in air via valve 78 and holds closed check valve 77, the latter thus preventing escape of air from the bladder while the pump draws in a fresh charge of air.

Next is the Reciprocating Mode illustrated in FIG. 15 where piston 75 has been rotated 90°, passage 79 (FIG. 13) is blocked, and air pressure within the "system" comprising the pump, the bladder and interconnecting passage 81 is al positive. Accordingly, any air in part **79*a* of line 79 would cause check valve 77 to remain closed, and air would merely reciprocate in line 81** between the pump and the bladder as the person walks.

Lastly, when the user wishes to cease the pump action and deflate the system, he merely rotates the knob and piston back 90° to the condition of FIG. 13, and then presses actuator 90 of relief valve 78. This allows air under pressure to exit from the pump via line 80 (FIG. 14) and from the bladder via line 79A (FIG. 13) by bleeding out past check valve 77, the latter being closed in reaction to pressure spikes, but not under this deflation bleeding condition.

In the operation of this valve the bladder is inflated to about 2½ to 3 psi or other comfort level. In Reciprocating mode the pressure periodically spikes to about 5 psi. The relief check valve includes a spring that holds this valve closed with a force of abut 0.3 pounds. During Fill mode (FIG. 13) the pump's suction is easily enough to open this valve.

In summary, valve assembly 70 is a very compact and efficient apparatus to handle all modes of operation with a single small mechanism, and with knob or actual movable between only two states, and finally a simple relief valve to deflate. Obviously, all these functions could be separated: the intake valve could be on or associated with the bladder directly and the relief valve could be on or associated with the bladder directly. Then the principal reciprocating mode would be much simpler; however, such would require three separate valves instead of one as disclosed herein.

The invention has been described with particular reference to a presently preferred embodiment. However, it will be apparent to one skilled in the art that variations and modifications of the disclosed embodiment are possible without departing from the spirit and scope of the invention claimed below.

We claim:

1. A method of applying cyclic pressure to the veins within a person's leg, this method being applicable during normal walking where there is a sequence that the heel strikes the floor followed by the calf contracting and the heel rising as weight is shifted to the ball of the foot, comprising the steps:

a-engaging the outer surface of the leg in the area of the calf; and b-applying pressure to said engaged surface cyclically and only when the heel strikes and engages the floor during normal walking.

2. A method according to claim 1 wherein step (a) comprises providing a cyclically inflatable air pressure chamber around the person's leg, and step (b) comprises providing an air pump only beneath the person's heel, said pump being cyclically actuated by the person's heel each time the person puts his weight on said heel, and providing an air conduit between said pump and air pressure chamber, whereby said air pump, said air pressure chamber and said air conduit form a air system which applies pressure to the person's leg each time the person puts his weight on his heel and releases pressure from the leg each time the person stops applying his weight on his heel.

3. A method according to claim 1 comprising the further step (c) of engaging and applying generally constant pressure to the outer surface of the person's foot in the area of the instep and the ankle.

4. A method according to claim 3 wherein step (c) comprises applying an elastic sock to the person's foot.

5. A method for applying cyclic pressure to veins within a person's leg by applying cyclic pressure to an outer surface of the leg, comprising the steps:

a-providing an air pump only beneath the person's heel, said pump being cyclically actuated by the person's heel each time the person puts his weight on said heel, b-providing an air pressure chamber around the person's leg, c-providing an air conduit between said pump and air pressure chamber, whereby said air pump, said air pressure chamber and said air conduit form an air system which applies pressure to the person's leg only when the person puts his weight on his heel, and releases pressure from the leg each time the person stops applying his weight on his heel, and comprises the further steps of providing suction and compression stages to said pump and providing valve means for said pump, whereby the valve means in its open state allows air to be drawn in from the atmosphere by the pump, and the valve means in closed state allows the pump to pump the drawn-in air into the said pressure chamber, such that the system is self-inflatable without need of an external air pump or compressed air source.

6. A portable apparatus for applying cyclic pressure to veins within a person's leg by applying cyclic pressure to an outer surface of the leg, the apparatus comprising:

a-a first air chamber having a flexible wail portion and means for releasably securing said wall portion to the person's leg adjacent an outer surface of the person's leg, b-a second air chamber and means for releasably securing this second air chamber to the person's foot only beneath the person's heel, this second chamber being compressible from an uncompressed state to force air out of it when the person's heel bears downward thereon and returnable to its uncompressed state when the downward heel force is removed therefrom, c-conduit means for permitting air flow between said first and second air chambers, whereby air flows from the said second chamber into said first chamber and pressure is cyclically increased in said first chamber urging said wail portion against the leg when the person's heel presses downward on said second chamber, and air flows from the first to second chamber and pressure on the leg is reduced when the person's heel stops pressing on said second chamber.

7. Apparatus according to claim 1 wherein said second chamber is a pump formed of integrally molded walls, at least one wall being flexible and resilient to allow the chamber to be compressed and to return to its uncompressed state.

8. A portable apparatus for applying cyclic pressure to veins within a person's leg by applying cyclic pressure to an outer surface of the leg between the knee and the ankle, the apparatus comprising:

a-a first air chamber having a flexible wail portion adapted to be situated adjacent an outer surface of the leg, b-a second air chamber and means for releasably securing said chamber only beneath the person's heel, this second chamber being compressible from an uncompressed state to force air out of it when the person's heel bears downward thereon and returnable to its uncompressed state when the downward heel force is removed therefrom, c-conduit means for permitting air flow between said first and second air chambers, whereby air flows from the said second chamber into said first chamber and pressure is cyclically increased in said first chamber urging said wall portion against the leg when the person's heel presses downward on said second chamber, and air flows from the first to second chamber and pressure on the leg is reduced when the person's heel stops pressing on said second chamber, and d-additional pressure means for applying pressure to the outer surface of the person's foot in the area between the toes of the instep and the ankle while said first chamber is situated adjacent an outer surface of the leg between the knee and the ankle.

9. Apparatus according to claim 8 and operable with an external source of air at a pressure greater than atmospheric air, wherein said conduit means comprises valve means which is variable between first, second and third states which establish communication respectively (a) between said chambers and said external source for receiving air into said chambers, (b) between said chambers and the atmosphere for discharging air from said chambers to the atmosphere, and (c) between said chambers whereby air can move between said chambers.

10. Apparatus according to claim 8 wherein said chambers and conduit comprise an air system, said air system further comprises valve means having three different states and being selectively operable between them, the states being: (a) open to allow introduction of air into said system, (b) open to release of air out of said system, and (c) closed to maintain a fixed quantity of air in the system.

11. Apparatus according to claim 10 operable with an external source of air wherein said valve means has a first state for allowing air from an external source thereof to enter the second chamber, a second state for allowing the admitted air in the second chamber to be pumped into the first chamber, thereby increasing the pressure of the system, a third state for maintaining a fixed volume of air in the system, and a fourth state for allowing air to exit the system.

12. Apparatus according to claim 11 operable with an external source of air at a pressure greater than atmospheric air, wherein said valve means in said second state is connected to an external source for receiving air therefrom.

13. Apparatus according to claim 11 wherein said valve means comprises a single housing and selector means for actuating said valve between said four states.

14. Apparatus according to claim 13 wherein said valve further comprises a cylinder with ports in the cylinder wall and a piston movable within the cylinder for closing and opening said ports, whereby movement of said selector moves the piston to selectively open and close said ports.

15. Apparatus according to claim 10 wherein said first chamber comprises inner and outer sheets having adjacent peripheral edges which are joined together in air tight seals, said first chamber adapted to be wrapped around a person's leg and releasably secured thereto, said first chamber having opposite side edges, coupling means for releasably securing one of said side edge to the other, a nozzle connected to said first chamber and communicating with said air space for inlet and discharge of air into and from said air space, said first chamber being flexible to readily conform to the leg and to expand when inflated by air flow into said air space, whereby said inner sheet applies pressure to the leg.

16. Apparatus according to claim 15 where this apparatus is applied to a person's leg, and wherein said double-layer sheet comprises an inner layer applied against the outer surface of the leg and an opposite outer layer, said outer layer being flexible but generally non-stretchable, said inner layer being both flexible and stretchable.

17. Apparatus according to claim 16 wherein said outer layer is woven nylon with an inner surface of urethane, said inner layer is urethane, said two layers are sealed together forming an air-tight chamber except for said nozzle for inlet and exit of air.

18. Apparatus according to claim 16 wherein said sheet has a generally trapezoid shape with the large and small edges being the top and bottom respectively.

19. Apparatus according to claim 15 wherein said sheet is dimensioned to extend from slightly below the knee to slightly above the ankle.

20. Apparatus according to claim 15 wherein coupling means on said opposite side edges comprises mating tabs of material which are repeatedly engageable and releasable.

21. Apparatus according to claim 15 wherein said sheet further comprises on the outside of the outside layer means for holding said valve means.

22. Apparatus according to claim 15 wherein said inner and outer sheets are secured together at a plurality of spaced apart sites inward of their peripheral edges, so that upon inflation the inner sheet will extend away from the outer layer only in areas not secured together.

23. Apparatus according to claim 22 wherein said sites where the inner and outer layers are secured together each define a sealed area through which extends an aperture transverse of said layers, said sealed area surrounding each aperture being air-tight so that the air space between the outer and inner layers remains air-tight while air can traverse the sheet through said aperture.

24. Apparatus according to claim 15 further comprising a sock element having a heel part at the bottom and an ankle part at the top, said heel part having means for positioning and maintaining said pump below the person's heel, said ankle part being secured to the bottom part of said sheet.

25. Apparatus according to claim 24 wherein said sock element comprises a lower part for surrounding the person's instep and part of the person's sole, said lower part being stretchable at least in the circumferential direction and being dimensioned to fit tightly about the person's foot and to apply a compression force thereto.

26. Apparatus according to claim 24 wherein said sock element further comprises means for holding the conduit part that extends from the pump to the valve.

27. Apparatus according to claim 10 wherein said first chamber comprises a double-layer sheet, coupling means for releasably securing the sheet wrapped around the person's leg, said double layer sheet defining between said layers air space, the adjacent inner surfaces of said layers being air-tight, a nozzle for inlet and discharge of air in and from said air space, said sheet being flexible to readily conform to the leg and to expand when inflated by air flow into said air space, whereby said inner layer applies pressure to the leg.

28. Apparatus according to claim 27 wherein coupling means on said opposite side edges comprises mating tabs of material which is repeatedly engagable and releasable.

29. Apparatus according to claim 10 operable with an external cyclic pump, producing pressure greater than atmospheric air, wherein said valve means comprises coupling for air flow from said external pump into said first chamber as an optional alternative to air flow from said second chamber, and for air flow out of said second chamber.

30. Apparatus according to claim 10 wherein said valve means allows air from outside the system to enter the second chamber and be pumped into the first chamber as the person walks, such that the system is self-inflatable without need of an external air pump or compressed air source.

31. Apparatus according to claim 8 wherein said chambers and conduit means form an air system, said air system further comprises a one-way inlet valve with open and closed states and a discharge valve with open and closed states, means for opening said one-way inlet valve to allow entry of air into the system, means for opening said discharge valve to allow air to exit the system, and means for closing, both valves to maintain a fixed quantity of air in said air system, with air in the system free to move between said chambers.

32. Apparatus according to claim 8 wherein said additional pressure means applies substantially constant pressure.

33. Apparatus according to claim 32 wherein said additional pressure means comprises an elastic sock at least partially encasing the person's heel and instep.

34. Apparatus according to claim 8 wherein said additional pressure means comprises an elastic sock adapted to at least partially encase the outer surface of the person's foot in the area of the ankle and instep and to engage and maintain said second air chamber positioned beneath the person's heel.

35. A portable apparatus for applying cyclic pressure to veins within a person's leg, comprising:

a-first means for engaging an outer surface of the person's leg in the area of the calf, b-second means for urging said first means against and thereby applying pressure to said outer surface of the person's leg, and c-third means for actuating said second means, and means for releasably securing said third means only beneath a person's heel and being actuated when the person walks and his heel bears downward thereon, the third means being returnable to unactuated state when the downward heel force is removed therefrom.

36. A portable apparatus for applying cyclic pressure to veins within a person's leg by applying cyclic pressure to an outer surface of the leg, the apparatus comprising;

a-a flexible wail adapted to be situated adjacent an outer surface of the leg for applying pressure thereto, b-first means responsive to increased fluid pressure for maintaining and urging said wall against the person's leg, c-a pump and means for releasably securing this pump only beneath the person's heel, this pump being actuated when the person's heel bears downward thereon from an uncompressed state and returnable to its uncompressed state when the downward heel force is removed therefrom, d-conduit means for conducting fluid under pressure between said pump and said first means, whereby pressure is cyclically increased in said first means and thence to the leg when the person's heel presses downward on the pump, and fluid flows from the first means back to the pump and pressure on the leg is reduced when the heel stops pressing on said pump, e-additional pressure means for applying pressure to the outer surface of the person's foot in the area between the toes and the ankle.

37. Apparatus according to claim 35 wherein said first means comprises (a) a pair of shells formed generally as a set of halves of a longitudinally split cylinder, these shells adapted to encompass the leg, (b) a first air chamber maintained between the leg and at least one of said shells, and (c) coupling means for releasably securing said shells to encompass the leg.

* * * * *